United States Patent [19]

Enari et al.

[11] Patent Number: 4,816,819

[45] Date of Patent: Mar. 28, 1989

[54] DISPLAY PANEL

[75] Inventors: Masahiko Enari, Yokohama; Shinichi Yamashita, Kawasaki; Satoshi Omata, Tokyo; Mitsutoshi Kuno, Kawasaki; Hiroshi Inoue, Yokohama; Yoshiyuki Osada, Yokosuka, all of Japan

[73] Assignee: Canon Kabushiki Kaisha, Tokyo, Japan

[21] Appl. No.: 799,498

[22] Filed: Nov. 19, 1985

[30] Foreign Application Priority Data

Nov. 26, 1984 [JP] Japan ..... 59-248171

[51] Int. Cl.[4] ..... G09G 3/36

[52] U.S. Cl. ..... 340/811; 340/805; 340/784

[58] Field of Search ..... 340/784, 783, 803, 804, 340/805, 811, 802; 350/332, 333, 350 S

[56] References Cited

U.S. PATENT DOCUMENTS

| | | | |
|---|---|---|---|
| 4,040,721 | 8/1977 | Kurita | 340/784 |
| 4,342,994 | 8/1982 | Lorteije | 340/784 |
| 4,386,352 | 5/1983 | Nonomura et al. | 340/784 |
| 4,395,709 | 7/1983 | Nogae et al. | 340/811 |
| 4,447,812 | 5/1984 | Soneda et al. | 340/784 |
| 4,639,772 | 1/1987 | Urabe et al. | 340/784 |

*Primary Examiner*—Gerald L. Brigance

*Attorney, Agent, or Firm*—Fitzpatrick, Cella, Harper & Scinto

[57] ABSTRACT

A display panel having N scanning lines to which scan signal are inputted and M data lines to which information signals are inputted, includes transistor groups each connecting in common plural (n) scanning lines among N scanning lines, and a selector for selecting one of N/n scanning line blocks divided by the transistor groups.

6 Claims, 3 Drawing Sheets

DISPLAY PANEL

BACKGROUND OF THE INVENTION

1. Field of the Invention

The present invention relates to a display panel, and more particularly to a display panel with a reduced number of connections.

2. Description of the Prior Art

Known as a typical active matrix circuit board is a liquid crystal display device using TFTs (Thin-film-Transistors) as switching elements. Liquid crystal display devices have drawn attention as a substitute for CRT display devices. To meet the recent requirements for high resolution and high quality, the number of scanning lines reaches as many as several hundreds, and the circuit density is high.

FIG. 2 shows a circuit construction of a conventional active matrix type liquid crystal display device. In the figure, reference numeral 1 denotes a display unit 1, reference $A_{NM}$ denotes a TFT switching element for driving a pixel, reference numeral 2 denotes a signal line drive circuit, reference numeral 3 denotes a scanning line drive circuit, and reference numeral 4 denotes a connection point between the display unit 1 and the scanning line drive circuit 3. References G(1) to G(N) represent scanning lines, and references S(1) to S(M) represent signal lines. If a matrix arrangement N×M (N and M are positive integers) is employed for such a display device to connect N scanning lines and M signal lines, the number of connection points 4 becomes N. As to the circuit density, a compact liquid crystal television is here taken as an example which has 480 scanning lines, aspect ratio of 3:4, and diagonal screen size of 3 inches. In this case, since the vertical length l of the screen is:

$$l=3\times 25.4\ (mm)\times(3/5)\approx 46\ (mm)$$

the density d of scanning lines is:

$$d=(N/l)=(480/46)\approx 10.4\ (\text{line}/mm)$$

which shows a density of about 10 lines per 1 mm.

Under the necessity of connecting to a plural number of scanning lines of high density to an external scanning line drive circuit, there have been some problems that reliability and yield in implementing such a device is low and cost is expensive. Furthermore, since the scanning line drive circuit requires N output lines, the circuit becomes bulky and expensive.

SUMMARY OF THE INVENTION

The present invention has been made in view of the above problems and seeks to reduce the number of connections between the scanning lines of an active matrix circuit board and an external scanning line drive circuit, simplify the implementation, improve the manufacturing yield, reduce the cost, and make the external scanning line drive circuit small, compact and inexpensive.

The above objects of the invention is achieved by the provision of the display panel having N scanning lines to which scan signal are inputted and M data lines to which information signals are inputted, the display panel comprising transistor groups each connecting in common plural (n) scanning lines among N scanning lines, and selector means for selecting one of N/n scanning line blocks divided by said transistor groups.

DETAILED DESCRIPTION OF THE PREFERRED EMBODIMENTS

According to the present invention, the scanning lines of the circuit board to be connected to the scanning line drive circuit are divided into plural groups of scanning lines connected in common by switching elements. The switching elements are interposed between the display unit and the connection points to the scanning line drive circuit. The switching elements connected to a group of scanning lines are collectively controlled to drive the scanning lines concerned. Therefore, it is possible to remarkably reduce the number of connections to the external drive circuit as compared with the conventional one.

Figure 1:
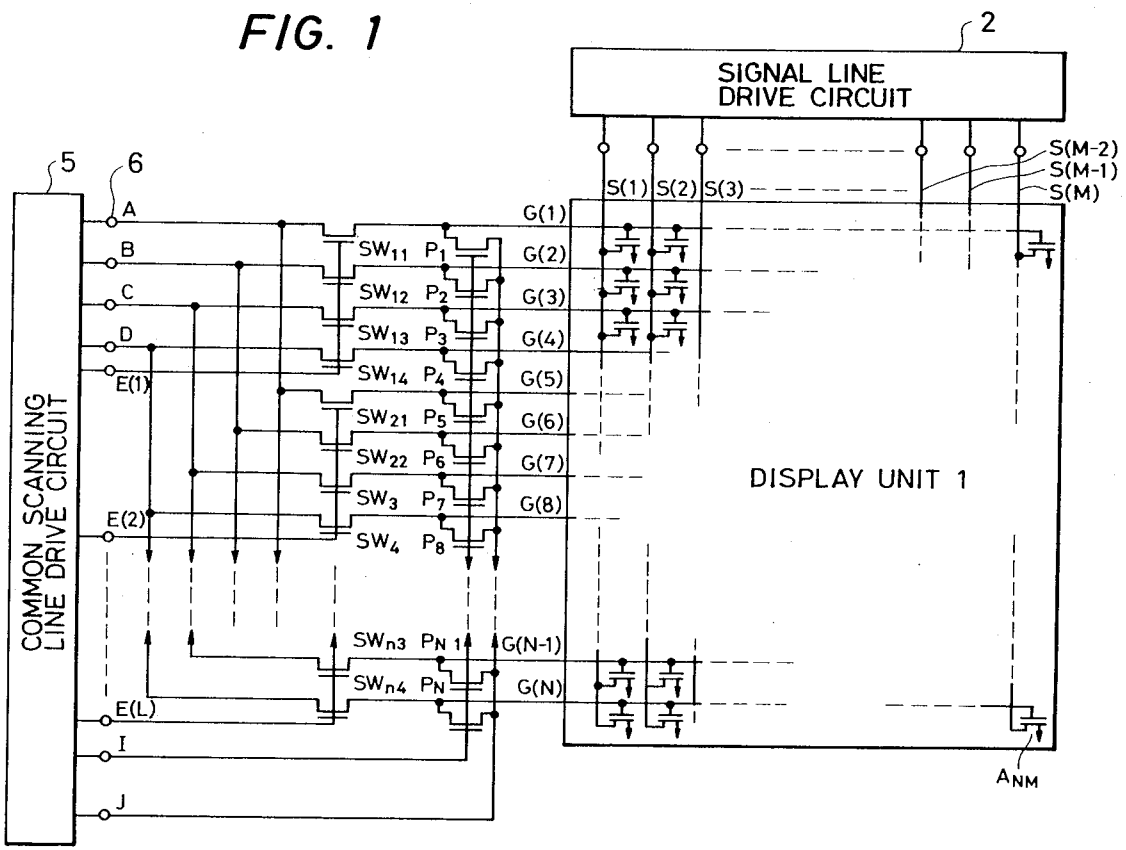
FIG. 1 is a schematic circuit construction showing an embodiment of the display device according to the present invention.
Figure 2:
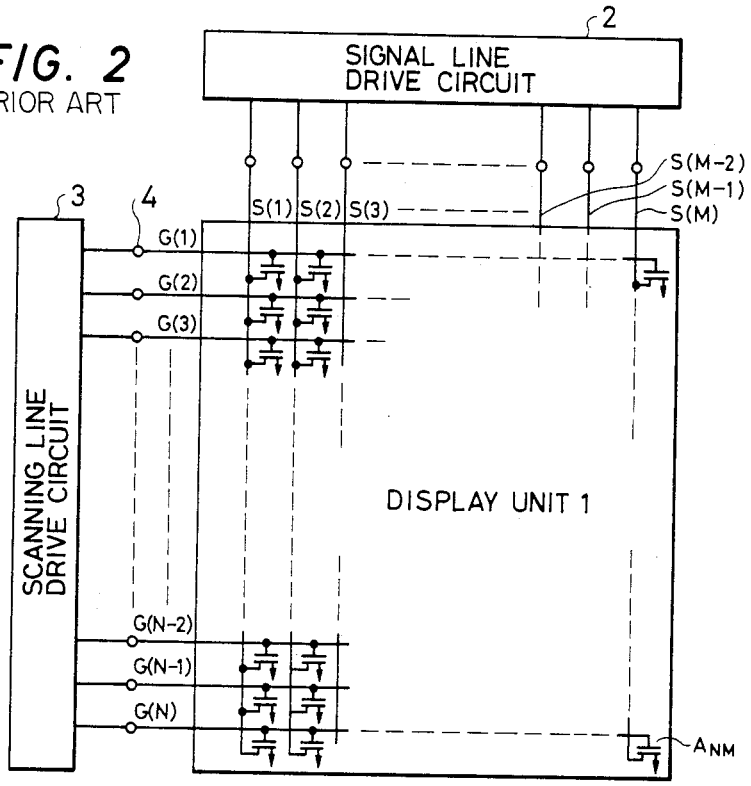
FIG. 2 PRIOR ART
FIG. 2 is a schematic circuit construction of a conventional active matrix type liquid crystal display device.

FIG. 1 shows the circuit construction of an embodiment of the present invention, wherein in the N×M active matrix type liquid crystal display device of FIG. 2, N scanning lines are divided into plural groups of four (n) common lines A, B, C and D.

Figure 3:
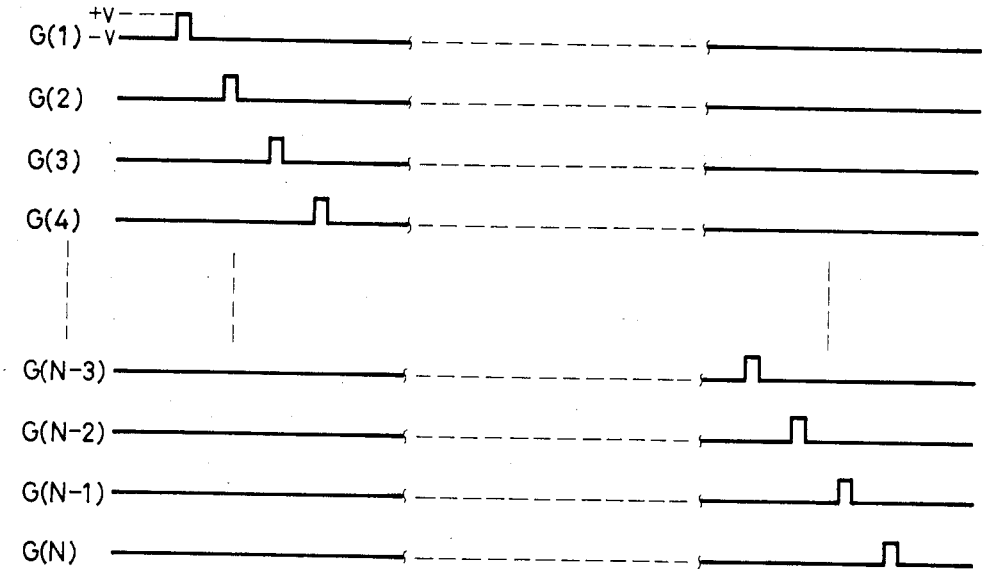
FIG. 3 shows the waveforms of scanning line drive signals.

In FIG. 2, references $SW_{11}$ to $SW_{n4}$ represent division switching elements, and references E(1) to E(L) represent division block selection lines for controlling the division switching elements. In this embodiment, the number of common lines is four so that the number L of scanning line blocks equals N/4. References $P_1$ to $P_N$ represent discharge switching elements, reference J represents a discharge potential line, reference number 5 represents a common scanning line drive circuit for driving the common scanning lines, and reference number 6 represents a connection point between the circuit board and the common scanning line drive circuit 5. FIG. 3 shows waveforms indicating the timings of drive signals to be supplied to the scanning lines G(1) to G(N) of the display unit 1, and FIG. 4 shows waveforms indicating the timings of each drive signal, in the embodiment of the present invention.

To drive the display device, pulses are sequentially applied from the common scanning line drive circuit 5 to the common lines A, B, C and D, and at the same time the division block selection lines E(1) to E(L) are sequentially turned on and off. In addition, to control the scanning lines G(1) to G(N) at a potential of - V(V) during non-selection, the discharge switching elements $P_1$ to $P_N$ are supplied with pulses on their discharge control lines I (refer to FIG. 4).

Figure 4:
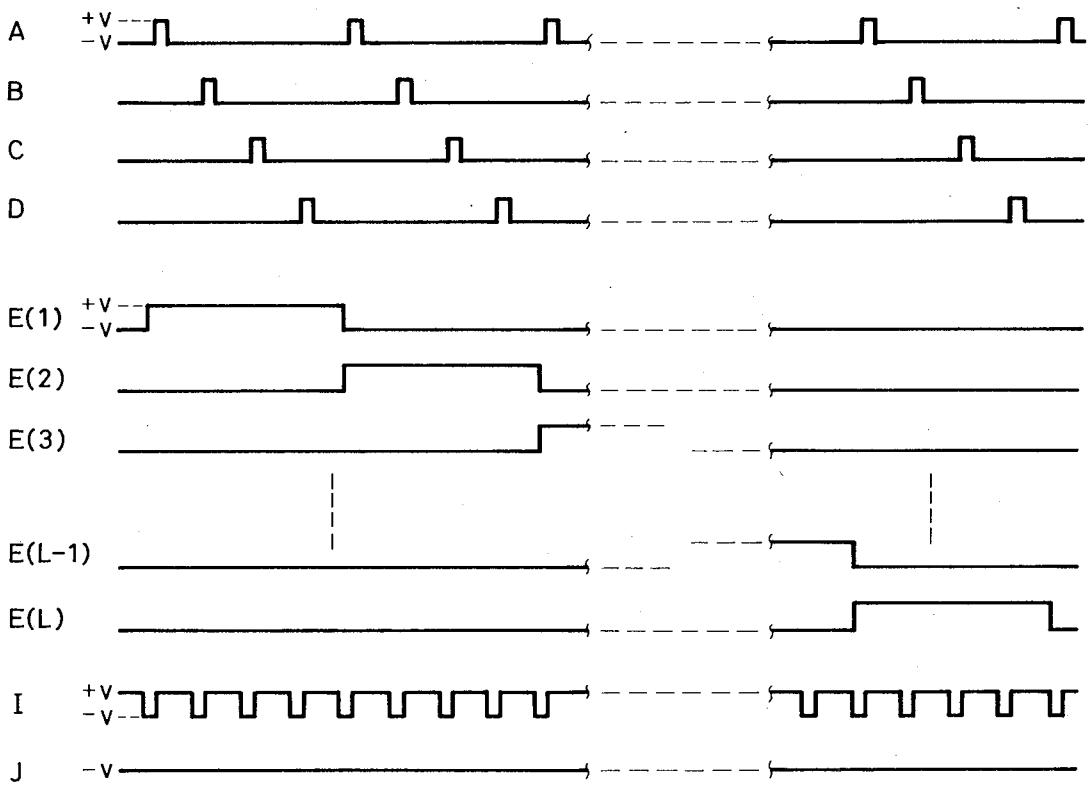
FIG. 4 shows the waveforms of respective drive signals of the common scanning line drive circuit.

As above, by controlling the common scanning line drive circuit 5 as shown in FIG. 4, it is possible to supply electrical signals shown in FIG. 2 to the scanning lines G(1) to G(N).

In the above embodiment, N scanning lines and four common lines have been employed. However, a combinaton of 480 scanning lines and 24 common lines may also be employed. In this case, the number of division block selection lines becomes 20. Therefore, the number of connections to the external drive circuit becomes 46 in total including two discharge control line and discharge potential line. This is effective in that the number of connections reduces approximately by 90%.

Furthermore, the division switching elements and discharge switching elements have the same function as the pixel drive switching elements so that all of the switching elements may be fabricated on the same substrate.

The display unit 1 to be used with the present invention may be a liquid crystal display panel. The liquid crystal panel may be an active matrix type display panel provided with switching transistors for respective pixels as shown in FIG. 1, or a dot matrix type display panel whose scanning lines and data lines are disposed on the respective opposite surfaces of the substrate. A twisted nematic liquid crystal is suitable for use with the active matrix type display panel, while a chiralsmetic liquid crystal of bistability is suitable for use with the dot matrix type liquid crystal.

According to the present invention, the scanning lines of the dot matrix circuit board or active matrix circuit board are divided into plural groups of scanning lines connected in common by switching transistors, to thereby enable a reduction in number of connections. Specifically, in case of the active matrix circuit board, the transistors for switching the pixels and the transistors connected to the scanning line blocks are integrally formed in the same substrate. Therefore, the number of connections between the scanning lines on the circuit board and the external drive circuit can be reduced, and it is possible to simplify the circuit implementation, improve the manufacturing yield, and reduce the cost. It is also effective in making the scanning line drive circuit small, compact and inexpensive.

We claim:

1. A driving apparatus for supplying scan display signals to scanning lines comprising:

N scanning lines (G(1), G(2) . . . G(N)) each connected to each one of M signal lines;

N first transistors each connected to a different one of said N scanning lines, wherein said first transistors are divided into N/n blocks where $n<N$;

N second transistors each connected to a different one of said scanning lines;

a plurality of first gate lines each connected to gates of n first transistors in each of said blocks, wherein each of said first gate lines is cyclically selected;

a plurality of first source lines each connected to a source of one of said n transistors in each of said blocks, wherein each of said first source lines is cyclically selected;

a second gate line connected to gates of said N second transistors;

a second source line connected to sources of said N second transistors;

first applying means for applying a positive voltage to said first source line selected from among said first source lines and for applying a negative voltage to the other first source lines;

second applying means for applying a positive voltage to said gates of said first transistors connected to said first gate line selected from among said first gate lines;

third applying means for applying a negative voltage to said gates of said second transistors in synchronization with said positive voltage supplied to said selected first source line; and fourth applying means for always applying a negative voltage to said sources of said second transistors.

2. A driving apparatus according to claim 1, wherein each of said N scanning lines scans a display including pixels.

3. A driving apparatus according to claim 2, wherein said pixels include liquid crystals.

4. A driving apparatus according to claim 3, wherein said liquid crystals are twisted nematic liquid crystals.

5. A driving apparatus according to claim 3, wherein said liquid crystals are chiral smetic liquid crystals.

6. A driving apparatus according to claim 2, wherein each of said pixels is connected to a transistor.

* * * * *

UNITED STATES PATENT AND TRADEMARK OFFICE

CERTIFICATE OF CORRECTION

PATENT NO. : 4,816,819

DATED : March 28, 1989

INVENTOR(S) : Enari, et al.

It is certified that error appears in the above-identified patent and that said Letters Patent is hereby corrected as shown below:

On the title page:

[56] REFERENCES CITED

U.S. Patent Documents, "Nogae, et al." should read --Nagae, et al.--; and

[57] ABSTRACT line 2,

"signal" should read --signals--.

COLUMN 1

Line 65, "signal" should read --signals--.

COLUMN 2

Line 67, "binaton" should read --bination--.

Signed and Sealed this

Twenty-seventh Day of February, 1990

*Attest:*

JEFFREY M. SAMUELS

*Attesting Officer* *Acting Commissioner of Patents and Trademarks*